US007178376B2

(12) United States Patent
Bergue et al.

(10) Patent No.: US 7,178,376 B2
(45) Date of Patent: Feb. 20, 2007

(54) FORGING PRESS OF THE HOT-DIE TYPE AND THERMAL INSULATION MEANS FOR THE PRESS

(75) Inventors: Jean-Pierre Bergue, Soisy sous Montmorency (FR); Gilbert Leconte, Asnieres sur Seine (FR)

(73) Assignee: Snecma, Paris (FR)

( * ) Notice: Subject to any disclaimer, the term of this patent is extended or adjusted under 35 U.S.C. 154(b) by 0 days.

(21) Appl. No.: 11/319,129

(22) Filed: Dec. 28, 2005

(65) Prior Publication Data

US 2006/0156783 A1 Jul. 20, 2006

(30) Foreign Application Priority Data

Jan. 14, 2005 (FR) ..... 05 50127

(51) Int. Cl.
*B21D 37/16* (2006.01)

(52) U.S. Cl. ..... 72/342.8; 72/342.1; 72/470; 100/321

(58) Field of Classification Search ..... 72/342.1, 72/342.7, 342.8, 352, 360, 462, 470, 476, 72/478; 100/321, 322, 323
See application file for complete search history.

(56) References Cited

U.S. PATENT DOCUMENTS 3,926,029 A 12/1975 Abson et al.
3,998,580 A 12/1976 Pfiffer
4,212,189 A * 7/1980 Fuchs et al. ..... 72/478
4,635,461 A * 1/1987 Raymond ..... 228/6.1
4,788,842 A * 12/1988 Kopp et al. ..... 72/45
6,988,389 B2 * 1/2006 Hawkes ..... 72/262
2005/0204796 A1 * 9/2005 Foser ..... 72/342.8

FOREIGN PATENT DOCUMENTS

JP 63-171239 7/1988

* cited by examiner

*Primary Examiner*—Ed Tolan
(74) *Attorney, Agent, or Firm*—Oblon, Spivak, McClelland, Maier & Neustadt, P.C.

(57) ABSTRACT

The invention relates to a forging press of the hot-die type with an operating temperature above a temperature T, comprising two dies between two die support elements, a thermal insulation means being placed between each die and its support element.

Figure 1:
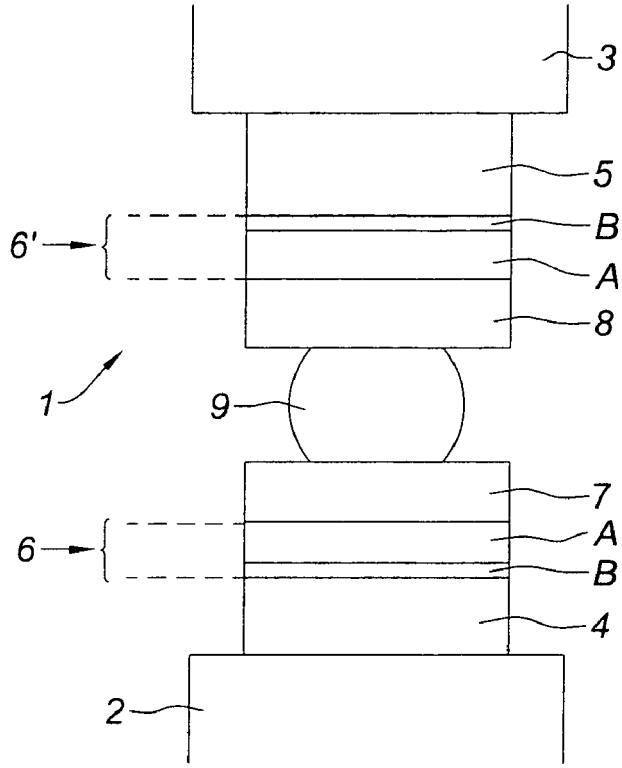

The press is characterized in that the said means comprises at least two superposed layers (A, B), a first layer (A) comprising a first material having mechanical and thermal properties suitable for operation at a temperature above the temperature T, a second layer (B) comprising a second material having mechanical and thermal properties suitable for operating at a temperature below the temperature T, the thermal conductivity of which is lower than that of the first material and is approximately equal to 0.2 W/m·K, with a tolerance of 10%.

Thanks to the invention, it is possible to obtain an effective thermal insulation means of small thickness.

9 Claims, 1 Drawing Sheet

FORGING PRESS OF THE HOT-DIE TYPE AND THERMAL INSULATION MEANS FOR THE PRESS

The invention relates to a forging press of the hot-die type, especially for isothermal forging, and to a thermal insulation means for the press.

In hot-die forging, an upper die is lowered against a lower die in order to progressively press the part to be forged, the dies being heated to high temperature (typically above 800° C.). In this type of forging, the material of the part to be forged is, owing to the temperature, in a state corresponding to its forgeability range. The duration of the forging in hot-die forging is relatively long, and in any event is not reduced to a short instant corresponding to a shock. This type of forging is generally used for forming parts that are difficult to forge, for example those having large surface areas or involving metallurgically complex materials.

The invention relates firstly to a hot-die forging press and more precisely to a press for isothermal forging, that is to say forging in which the dies and the part to be forged are maintained at the same temperature, which is constant throughout the forging process. The invention also applies to the more general case of hot-die forging in which the dies are maintained at a constant temperature and in which the part, heated before forging to a temperature above that of the dies, is cooled during the operation.

A hot-die forging press generally comprises a lower die and an upper die, these being supported by a lower press bed and an upper press bed, optionally via a support platen. Since the temperature of the material of the part to be forged has to be uniform, so as to avoid the appearance of forging defects such as folds or cracks, and so as to promote the formation of high-performance microstructures in the forged part, the dies have to be at very high temperature (above 800° C.), whereas the beds or the intermediate platens, often made of steel, must remain at a low temperature in order to maintain their mechanical properties. Consequently, it is necessary to provide good thermal insulation between the dies and their support bed or platen.

For this purpose, the prior art teaches the provision, between each die and its support element, of a thermal insulation means comprising a succession of thick plates (generally two to three plates) made of metal alloys and of materials having a low thermal conductivity, for example bulk ceramics such as zirconia, silica or pyrolitic graphite, and possessing high mechanical strength at a high temperature.

Document JP 63 171 239 proposes the provision of a layer of ceramic ($Si_3N_4$ or $ZrO_2$) between each intermediate plate, placed in a structure comprising juxtaposed columns of polygonal cross section.

These insulation means have a very great thickness, since the thermal gradient between the dies and their support elements is very large. To give an example, the thickness of such a means, for each bed of a 4000-tonne press, may be 600 millimetres, i.e. in total 1200 millimetres for the press, which correspondingly reduces the available distance between the beds in order to place the part to be forged.

Thus, it is not always possible to use conventional presses for hot-die forging and they have to be substituted with new presses, of larger dimensions, thereby considerably increasing investment and production costs.

Furthermore, these insulation means involve a large volume of materials that are intrinsically expensive (nickel-based superalloys, cobalt-based alloys, ceramics) and are difficult to machine. They are therefore very costly.

The Applicant has sought to reduce the thickness of the insulation means for hot-die forging presses so as to alleviate the abovementioned drawbacks.

Thus, the invention relates to a forging press of the hot-die type with an operating temperature above a temperature T, comprising two dies between two die support elements, a thermal insulation means being placed between each die and its support element, characterized in that the said means comprises at least two superposed layers, a first layer comprising a first material having mechanical and thermal properties suitable for operation at a temperature above the temperature T, a second layer comprising a second material having mechanical and thermal properties suitable for operating at a temperature below the temperature T, the thermal conductivity of which is lower than that of the first material and is approximately equal to 0.2 W/m·K, with a tolerance of 10%.

Thanks to the invention, since materials with a low thermal conductivity usually have a low mechanical strength at high temperature, it is possible to lower the temperature sufficiently thanks to the layer of the first material in order for the second material to be in a temperature range in which its mechanical properties are sufficient for its use in a press, this second material, thanks to its low thermal conductivity, allowing the support element to be effectively insulated with respect to the die. The thickness of the means may thus be reduced: it suffices for the thickness of the first layer to be sufficient to thermally protect the second layer, so that it maintains its mechanical properties, which can then be of very small thickness if it possesses a very low thermal conductivity.

Thus, by combining the mechanical and thermal properties of the two layers, it is possible to reduce the thickness of the thermal insulation means placed between each die and its support element.

Preferably, the temperature T is equal to 800° C.

Also preferably, the die support elements are made of steel.

Again preferably, the press is designed for forgings that are forged at a pressure above 20 MPa.

Advantageously, the first material has a thermal conductivity approximately equal to 2 W/m·K, with a tolerance of 10%, and is in particular a ceramic.

Also advantageously, the second material is a hot-pressed mica paper.

By using these materials, the Applicant has been able to design an insulation means, for a 4000-tonne press, with a total thickness, for the two layers, of 100 millimetres, thus reducing the thickness of the insulation by more than 83% relative to the prior art.

As intermediate product, the invention also relates to an insulation means for the forging press of the hot-die type defined above, which is in the form of a plate which comprises at least two superposed layers, a first layer comprising a first material having mechanical and thermal properties suitable for operation at a temperature above the temperature T, a second layer comprising a second material having mechanical and thermal properties suitable for operation at a temperature below the temperature T, the thermal conductivity of which is lower than that of the first material and is approximately equal to 0.2 W/m·K, with a tolerance of 10%.

The invention applies particularly to isothermal forging, but the Applicant does not intend to limit the scope of its rights to this application.

Figure 2:
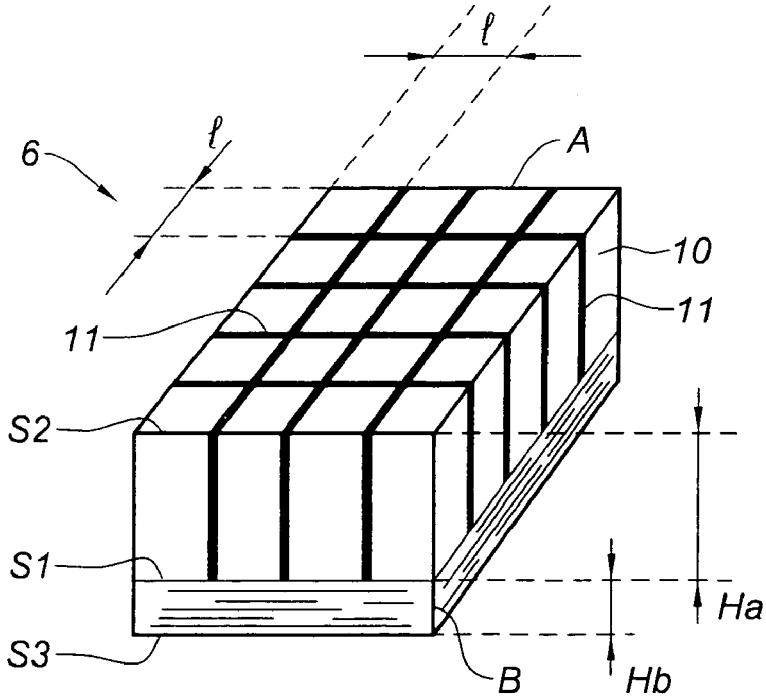

The invention will be more clearly understood with the aid of the following description of the hot-die forging press and of the thermal insulation means of the invention, with reference to the appended drawing in which:

FIG. 1 shows a schematic sectional view of the preferred embodiment of the hot-die forging press of the invention; and FIG. 2 shows a schematic partial view in perspective and in cross section of the preferred embodiment of the thermal insulation means of the invention.

Referring to FIG. 1, the hot-die forging press 1 of the invention comprises a lower press bed 2 and an upper press bed 3 that faces the lower bed 2. The upper bed 3 may be moved in vertical translation relative to the lower bed 2. The lower bed 2 and the upper bed 3 each support an intermediate platen, namely the lower platen 4 and the upper platen 5 respectively, here made of steel.

Each intermediate platen. 4, 5 supports a die, namely the lower die 7 and the upper die 8 respectively, for supporting and for pressing a part 9 to be forged. The part 9 to be forged typically comprises a metal alloy, requiring the use of a hot-die forging process. In the particular case in question, this is an isothermal forging operation. Lateral insulation means, not shown but well known to those skilled in the art, allow such a process to be carried out.

A thermal insulation means 6, 6' is lodged between each platen 4, 5 and the die 7, 8 that it supports. The two thermal insulation means 6, 6' here are identical and take the form of a plate with a parallelepipedal shape of polygonal base, matched to the geometry of the platen 4, 5 and of the die 7, 8 between which they are lodged, these facing in one direction or the other depending on whether they are in the lower position (6) or upper position (6'). The shape of the platens, dies and thermal insulation means is given here by way of indication but is not limiting. The platens and dies could have a circular or polygonal cross section, the insulation means then taking the form of a plate with a suitable circular or polygonal base.

The dies 7 and 8 are heated to a high temperature T, for example, in the case of a part 9 to be forged made of titanium alloy or nickel alloy, of above 800° C, by suitable heating means, for example electrical resistors (not shown).

Referring to FIG. 2, each thermal insulation means 6, 6' comprises two stacked insulating layers A and B, made of different materials. The first layer A comprises a first material, in this case a ceramic, more precisely a monolithic ceramic of the zirconia type, which has a first thermal conductivity. In this case, it is a magnesia (MgO)-stabilized ceramic. The lower the thermal conductivity of a material, the greater the thermal insulation capability of this material. The second layer B comprises a second material, in this case mica, more precisely mica sold under the brand name PAMITHERM, which has a second thermal conductivity. Each thermal insulation means 6, 6', thanks to its two stacked layers A, B, provides a thermal insulation function between a die 7, 8 and its intermediate support platen 4, 5. The first layer A is located on the same side as the die 7 or 8, the second layer B on the same side as the intermediate platen 4 or 5. The thermal conductivity of the second layer B is lower than the thermal conductivity of the first layer A.

The first layer A comprises here a juxtaposition of ceramic columns 10 of polygonal or circular cross section. The columns 10 here are of cylindrical form. These columns may be completely imbricated with respect to one another, as in the abovementioned document JP 63 171 239, or, as in the particular case in question, separated by partitions 11, or fill material 11, comprising another suitable material, such as a fibrous insulation of the rock wool type. This type of combination between ceramic columns 10 and a thermal insulation fill material 11 is well known to those skilled in the art of thermal insulation. The cylindrical columns 10 here are offset with respect to one another so as to reduce the spaces between them. The zirconia-type monolithic ceramic possesses very good mechanical properties, especially strength, up to close to 1200° C. and therefore is well able to maintain its mechanical properties at the working temperature T of the dies 7 and 8, here above 800° C. Its thermal conductivity is in this case approximately equal to 2 W/m·k, with a tolerance of 10% (in this case, the thermal conductivity is that of the first layer A, that is to say of the combination of the ceramic columns 10 and of the fill material 11). The columns 10 are arranged so that the lower and upper surfaces of the first layer A are perfectly flat, the forces thus being uniformly distributed.

The second layer B takes the form here of a laminated layer of hot-pressed mica sheets. Mica has a very low thermal conductivity, in this case approximately equal to 0.2 W/m·K, with a tolerance of 10%, but its mechanical strength greatly decreases above a temperature somewhat below T, in this case above $T_0$=750° C. If the temperature to which it is subjected is below $T_0$, the second layer B can withstand being used in a press and possesses a very good thermal insulation capability.

In each insulation means 6, 6', the two layers A and B are in contact over one of their surfaces, denoted by S1 for both of them, the layer B is in contact with the intermediate platen 4, 5 over a surface S3, and the layer A is in contact with the die 7, 8 over a surface S2.

The ceramic layer A mechanically protects the mica layer B from the high temperature T of the die 7, 8, which is that of the surface S2, at which temperature the ceramic layer A maintains its mechanical properties, its thickness being designed so that, owing to its thermal conductivity, the temperature of the surface S1 is below $T_0$, in this case equal to about 550° C., that is to say corresponding to a temperature at which the mica layer B maintains sufficient mechanical strength for it to be used in a press. The layer B itself makes it possible to greatly lower the temperature between its surface S1 and its surface S3, owing to its low thermal conductivity. The temperature of the surface S3 is here about 300° C.

In other words, the two layers A, B are chosen according to their relative mechanical and thermal properties and are positioned relative to the dies 7, 8 so as to allow the use of a second layer B of low thermal conductivity, which maintains its mechanical properties thanks to the insulation provided by the first layer A relative to the die 7, 8.

In order for the surface S1 to be at a temperature below $T_0$, it is necessary for the thickness of the first layer A, owing to its thermal conductivity, to be at least equal to a given minimal thickness Ha. For a 4000-tonne press, this thickness Ha may be less than 80 millimetres. The cross section of the columns 10, whether this is square or rectangular, may for example in the present case have sides of length equal to about 40 to 60 millimetres. If the cross section of the columns 10 is circular, its diameter may be around 60 millimetres.

The thickness of the second layer B is chosen to be at least equal to a minimum height Hb so as, on account of its thermal conductivity, to lower the temperature of the surface S3 to a temperature that is acceptable for the intermediate platen 4, 5. In the above example, Hb may be less than 20 millimetres.

The thicknesses Ha and Hb are of course chosen to be as small as possible, but also to be sufficient to fulfil their insulation function that has just been described, depending on the temperatures that a person skilled in the art will determine.

For a 4000-tonne press, the total thickness (Ha+Hb) of the insulation means thus obtained may be less than 100 millimetres per die, i.e. 200 millimetres in total for the two means. The dimensions, and especially the thickness, of the system comprising the beds, their intermediate platens and the dies that they support are thus greatly reduced. It is therefore possible to employ a hot-die forging process on conventional presses, without having to increase their dimensions and permitting a vertical space between the dies that is sufficient for positioning the part 9 to be forged.

The two layers A and B may either be simply superposed one on the other, or suitably bonded together. A mechanical linkage may be provided between them, for example using ties which pass through the layers A and B and are fastened to the platen 4, 5 and to the corresponding die 7, 8, respectively.

The operation of the press 1 for a hot-die forging process is also completely conventional, the upper bed 3 being lowered in order to press the part 9 to be forged between the two dies 7, 8.

The invention claimed is:

1. Forging press of the hot-die type with an operating temperature above a temperature T, comprising two dies between two die support elements, a thermal insulation means being placed between each die and its support element, characterized in that the said means comprises at least two superposed layers (A, B), a first layer (A) comprising a first material having mechanical and thermal properties suitable for operation at a temperature above the temperature T, a second layer (B) comprising a second material having mechanical and thermal properties suitable for operating at a temperature below the temperature T, the thermal conductivity of which is lower than that of the first material and is approximately equal to 0.2 W/m·K, with a tolerance of 10%.

2. Press according to claim 1, in which the temperature T is equal to 800° C.

3. Press according to claim 1, in which the die support elements are made of steel.

4. Press according to claim 1, which is designed for forgings that are forged at a pressure above 20 MPa.

5. Press according to claim 1, in which the first material has a thermal conductivity approximately equal to 2 W/m·K, with a tolerance of 10%, and is in particular a ceramic.

6. Press according to claim 1, in which the second material is a hot-pressed mica paper.

7. Press according to claim 1, designed to carry out isothermal forging.

8. Insulation means for the forging press of the hot-die type of claim 1, which is in the form of a plate which comprises at least two superposed layers, a first layer comprising a first material having mechanical and thermal properties suitable for operation at a temperature above the temperature T, a second layer comprising a second material having mechanical and thermal properties suitable for operation at a temperature below the temperature T, the thermal conductivity of which is lower than that of the first material and is approximately equal to 0.2 W/m·K, with a tolerance of 10%.

9. Insulation means according to claim 8, the first material of which is a ceramic having a thermal conductivity approximately equal to 2 W/m·K, with a tolerance of 10%, and the second material is a hot-pressed mica paper having a thermal conductivity approximately equal to 0.2 W/m·K, with a tolerance of 10%.

* * * * *